US008539987B2

(12) United States Patent
Rossetti

(10) Patent No.: US 8,539,987 B2
(45) Date of Patent: Sep. 24, 2013

(54) PAPERMAKING FABRIC, IN PARTICULAR FOR USE IN THE FORMING SECTION OF A PAPERMAKING MACHINE

(75) Inventor: Clara Rossetti, Provaglio d'Iseo (IT)

(73) Assignee: Feltri Marone S.p.A. (IT)

( * ) Notice: Subject to any disclaimer, the term of this patent is extended or adjusted under 35 U.S.C. 154(b) by 0 days.

(21) Appl. No.: 13/058,144

(22) PCT Filed: Aug. 7, 2009

(86) PCT No.: PCT/IB2009/006500
§ 371 (c)(1),
(2), (4) Date: Jun. 6, 2011

(87) PCT Pub. No.: WO2010/015927
PCT Pub. Date: Feb. 11, 2010

(65) Prior Publication Data

US 2011/0226435 A1 Sep. 22, 2011

(30) Foreign Application Priority Data

Aug. 8, 2008 (IT) ..... MI2008A1499

(51) Int. Cl.
*D03D 25/00* (2006.01)
*D21F 1/10* (2006.01)

(52) U.S. Cl.
USPC ..... 139/383 A; 162/348

(58) Field of Classification Search
USPC ..... 139/383 A
See application file for complete search history.

(56) References Cited

U.S. PATENT DOCUMENTS

| | | | | |
|---|---|---|---|---|
| 4,515,853 | A | 5/1985 | Borel | |
| 6,145,550 | A | 11/2000 | Ward | |
| 6,899,142 | B2 * | 5/2005 | Birzele | 139/383 A |
| 7,373,957 | B2 | 5/2008 | Heger | |

OTHER PUBLICATIONS

European Patent Office as International Searching Authority; International Search Report and Written Opinion for PCT/IB2009/006500, Jul. 6, 2010 (International Filing date Aug. 7, 2009).

* cited by examiner

*Primary Examiner* — Eric Hug
*Assistant Examiner* — Jacob Thomas Minskey
(74) *Attorney, Agent, or Firm* — Klintworth & Rozenblat IP LLC

(57) ABSTRACT

A quadruple papermaking fabric comprises: a set of longitudinal machine direction top yarns; a set of cross machine direction top yarns interwoven with the top MD yarns to form a top fabric layer; a set of central MD yarns; a set of central CMD yarns interwoven with the central MD yarns to form a central fabric layer; a set of bottom MD yarns; a set of bottom CMD yarns interwoven with the bottom MD yarns to form a bottom fabric layer; a set of pairs of binder yarns arranged in the cross machine direction and interwoven with the top MD yarns. At least one of the binder yarns of each pair is interwoven with the central MD yarns to form a first binding pattern between the top layer and the central layer; at least some of the central CMD yarns define respective stitching yarns that are interwoven with the bottom MD yarns to form a second binding pattern between the central layer and the bottom layer.

11 Claims, 5 Drawing Sheets

PAPERMAKING FABRIC, IN PARTICULAR FOR USE IN THE FORMING SECTION OF A PAPERMAKING MACHINE

TECHNICAL FIELD

The present invention relates to a papermaking fabric, in particular a forming fabric for use in the forming section of a papermaking machine.

BACKGROUND ART

The traditional Fourdrinier papermaking process essentially consists of three steps, performed in succession in corresponding sections of the papermaking machine: the forming section, the press section, the dryer section.

In the forming section, an aqueous pulp of cellulose fibre (possibly also containing other components) is applied to a forming fabric in the form of an endless belt supported by rollers. The removal of water from the pulp through the forming fabric gradually leads to the formation of a strip of damp paper material, which still has a relatively high water content. More water is removed in the press section, where the paper material is pressed as it passes between one or more pairs of rollers. The paper material is then sent to the dryer section where it undergoes a final water-removal process. The paper thus formed is ready to undergo subsequent finishing and packaging processes.

As is common practice in the papermaking and papermaking fabric industry, in the following description the terms "machine direction" (abbreviated to "MD") and "cross machine direction" (abbreviated to "CMD") are used to indicate respectively a direction corresponding to the direction of the flow of the forming fabric in the papermaking machine, and a direction parallel to the surface of the fabric and crosswise (orthogonal) to the direction of the flow. The direction or orientation of the weft and warp yarns of the forming fabric are also indicated with reference to the machine direction and cross machine direction.

Again as is common practice in the sector, the surface of the forming fabric that comes into contact with the cellulose pulp (i.e. with the paper material being formed) is the top surface of the fabric; and the opposite surface facing the machine is the bottom surface. This reference is also used to describe the vertical spacing of the yarns in the forming fabric.

Although different types of fabrics suitable for use in the forming section are known in the prior art (such as those described, for instance, in U.S. Pat. No. 4,515,853, U.S. Pat. No. 3,885,603 and U.S. Pat. No. 6,145,550), there still appears to be room for improvement in this sector, for example in terms of mechanical strength, stability, life, draining capacity and quality of the formed paper.

DISCLOSURE OF INVENTION

The purpose of the present invention is to provide a papermaking fabric which exhibits these characteristics to a satisfactory level, and which is in particular entirely efficient, has a very good draining capacity, is resistant and stable in time, and guarantees the formation of high-quality paper.

The present invention thus relates to a papermaking fabric such as defined in its essential terms in claim 1 and, in its secondary features, in the dependent claims.

The present invention also relates to the use of said fabric in a papermaking machine, and specifically in the forming section of the machine, and a papermaking process in which said fabric is used.

BRIEF DESCRIPTION OF THE DRAWINGS

The invention will now be described in further detail in the following non-limiting embodiments, with reference to the accompanying drawings in which.

BEST MODE FOR CARRYING OUT THE INVENTION

Figure 1:
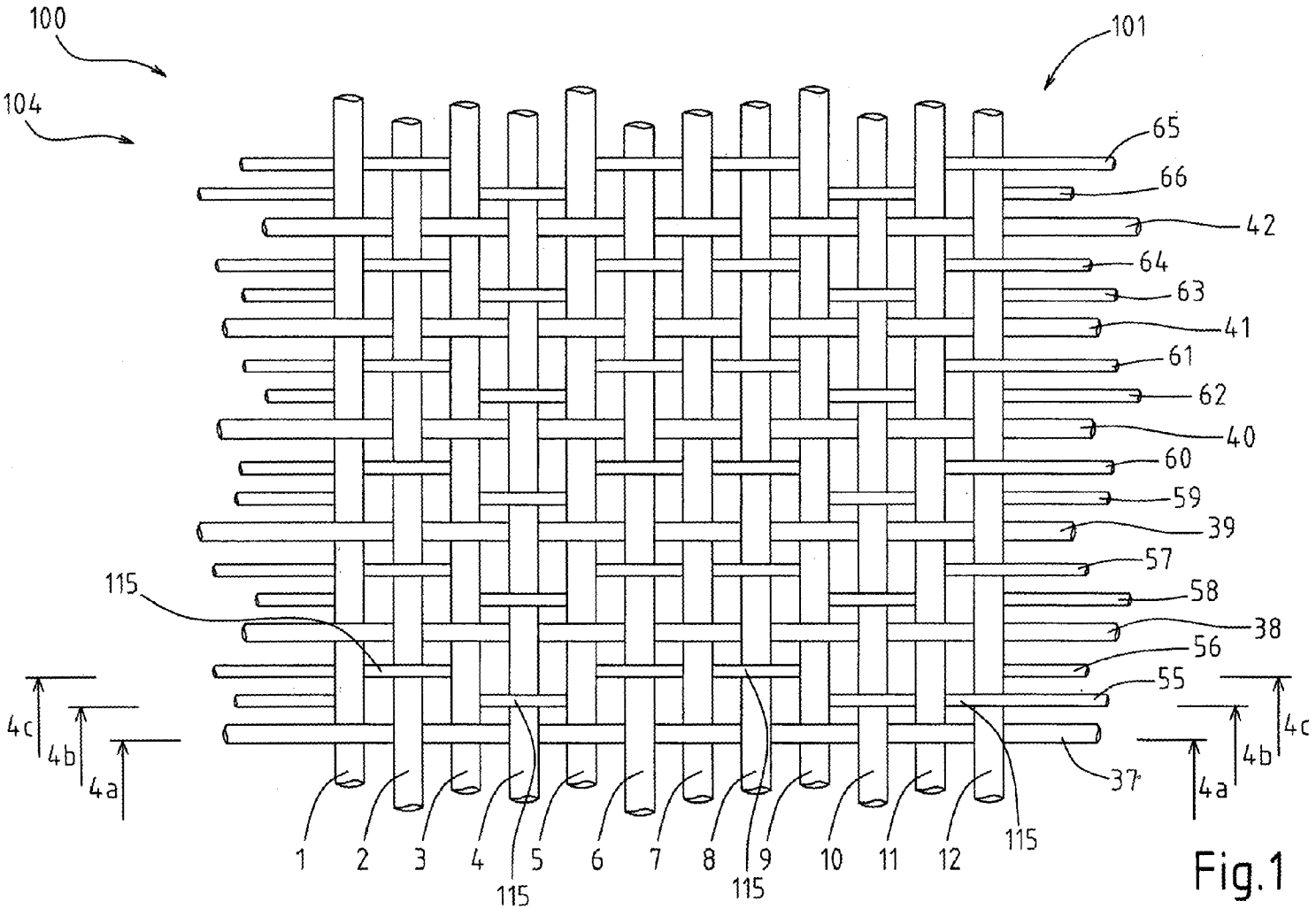
FIG. 1 is a schematic plan view from above of a top layer of a fabric repeat unit according to the invention.

With reference to the accompanying drawings, designated as a whole with number 100 is a papermaking fabric, in particular a forming fabric for use in the forming section of a papermaking machine; in the example shown, the fabric 100 is a 36-heddle quadruple papermaking fabric.

The fabric 100 comprises a top layer 101, a central layer 102 and a bottom layer 103 formed, in the usual way, by respective repeat units which together form a fabric repeat unit 104; in the figures only a single fabric repeat unit 104 is shown, but it is understood that in commercial and industrial applications the unit 104, and the repeat units of the single layers 101, 102, 103 can be repeated several times, both in the machine direction and in the cross machine direction, to form a fabric 100 of a suitable size for use in a papermaking machine.

The fabric 100 is normally formed by longitudinal warp yarns arranged in the machine direction (MD) and crosswise weft yarns, substantially orthogonal to the warp yarns, arranged in the cross machine direction (CMD). In the following description (and as is common practice in the sector) the longitudinal warp yarns arranged in the machine direction are referred to, for the sake of conciseness, as "MD yarns", and the crosswise weft yarns arranged in the cross machine direction are referred to as "CMD yarns".

In this case, the fabric 100 comprises twelve top MD yarns 1-12, six top CMD yarns 37-42, twelve central MD yarns 13-24, six central CMD yarns 43-48, twelve bottom MD yarns 25-36, six bottom CMD yarns 49-54, twelve binder yarns 55-66 arranged in pairs and comprising respective support portions 115 and respective binding portions 116.

As described more fully below, the top layer 101 (FIG. 1) includes in particular the top MD yarns 1-12 and the top CMD yarns 37-42, as well as the support portions 115 of the binder yarns 55-66; the central layer 102 (FIG. 2) includes the central MD yarns 13-24 and the central CMD yarns 43-48, as well as the binding portions 116 of the binder yarns 55-66; the bottom layer 103 (FIG. 3) comprises the bottom MD yarns 25-36 and the bottom CMD yarns 49-54, as well as stitching portions 117 of the central CMD yarns 43-48 which extend to bind the bottom MD yarns 25-36.

The way in which these yarns are interlaced or woven to form the fabric 100 is described in detail below.

Figure 4A:
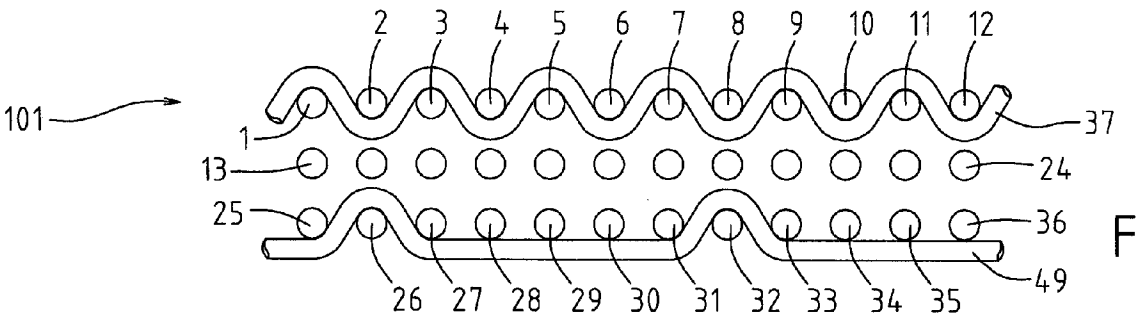
FIGS. 4*a*, 4*b*, 4*c*, 4*d* are cross-sectional views respectively along the planes 4*a*-4*a*, 4*b*-4*b*, 4*c*-4*c*, 4*d*-4*d* marked out in FIGS. 1 and 2.

With reference to FIGS. 1 and 4*a*, the top layer 101 comprises the top MD yarns 1-12, the top CMD yarns 37-42 and the support portions 115 of the binder yarns 55-66. The top MD yarns 1-12 and the top CMD yarns 37-42 are interwoven so that each top CMD yarn 37-42 passes alternately over and under the top MD yarns 1-12: in particular each top CMD yarn 37-42 passes over the odd-numbered top MD yarns 1, 3, 5, 7, 9, 11 and under the even-numbered top MD yarns 2, 4, 6, 8, 10. For example, as illustrated in FIG. 4*a*, the top CMD yarn 37 passes over the top MD yarn 1, under the top MD yarn 2, over the top MD yarn 3, under the top MD yarn 4, and so on until it passes under the top MD yarn 12. The other top CMD yarns 38-42 are interwoven with the top MD yarns 1-12 following the same pattern.

As illustrated in the figures as a whole, the layers 101, 102, 103 are joined and bound together to form the fabric 100 by a first binding pattern 105 and a second binding pattern 106; the two binding patterns 105, 106 are independent, in that in the fabric repeat unit 104 the top layer 101 is only bound, by the binding pattern 105, to the central layer 102; whereas the central layer 102 is only bound by the binding pattern 106 to the bottom layer 103; the binding patterns 105, 106 are formed by respective distinct sets of weft yarns, i.e. yarns arranged in the machine direction (so that these CMD yarns bind either the layer 101 to the layer 102, or the layer 102 to the layer 103); there are thus no CMD yarns that bind all three layers 101, 102, 103 nor, in particular, that bind the layer 101 directly to the layer 103.

The first binding pattern 105 is defined by the binder yarns 55-66 arranged in pairs which bind the top layer 101 and the central layer 102. As illustrated in FIG. 1, each pair of binder yarns 55-66 is arranged between two adjacent top CMD yarns 37-42. For example, the pair of binder yarns 55-56 is arranged between the top CMD yarns 37-38, the pair of binder yarns 57-58 is arranged between the top CMD yarns 38, 39, and so on.

Figure 2:
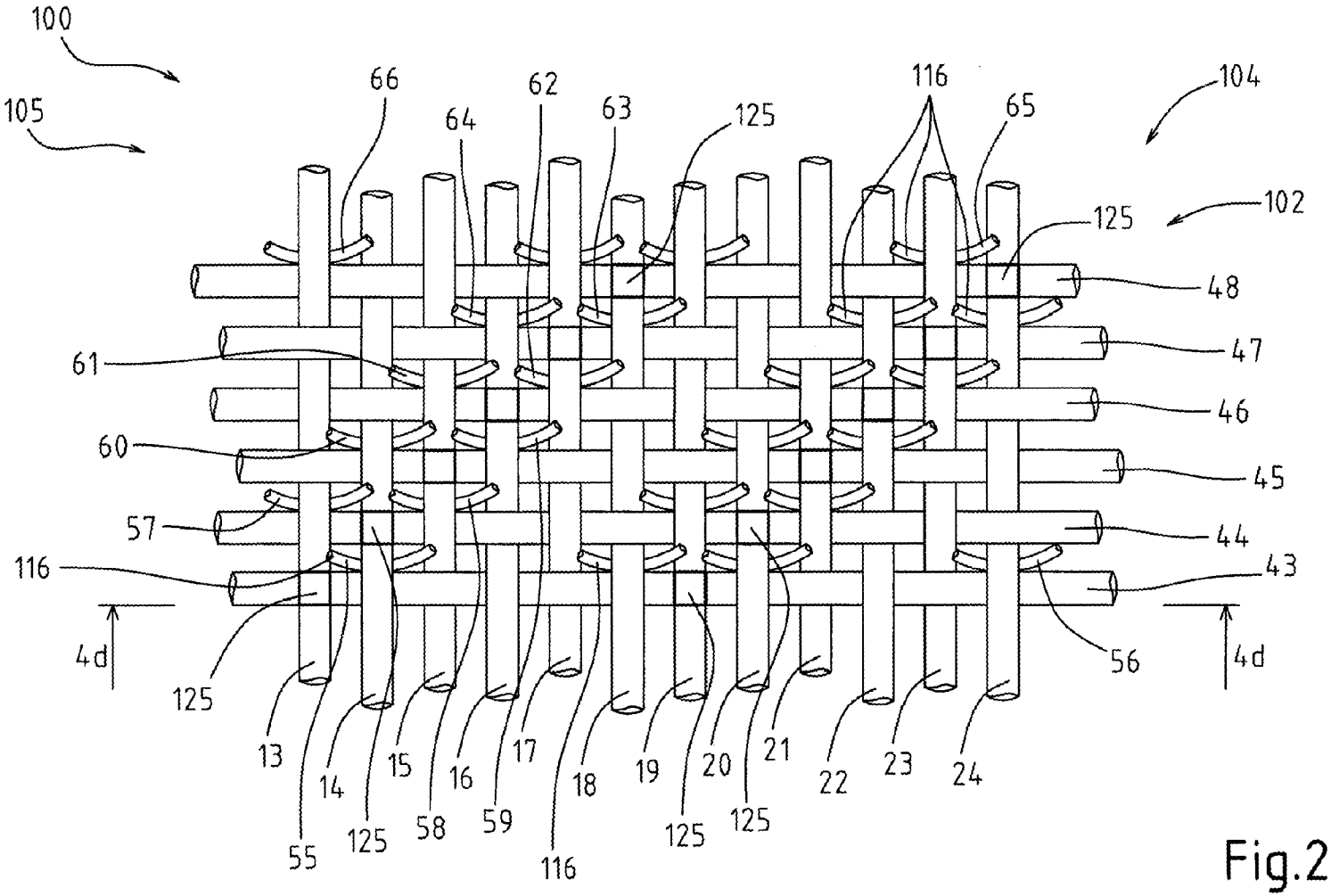
FIG. 2 is a schematic plan view from above of a central layer of the fabric of FIG. 1.

The second binding pattern 106 is defined by a second set of additional binder yarns or stitching yarns, which are separate from the binder yarns 55-66 and in this case are defined by respective central CMD yarns 43-48 which extend to bind the bottom MD yarns 25-36 by means of the respective stitching portions 117, thus binding the central layer 102 and the bottom layer 103 in a plurality of binding points 125 (schematically illustrated in FIG. 2 by thick-edged boxes).

Figure 3:
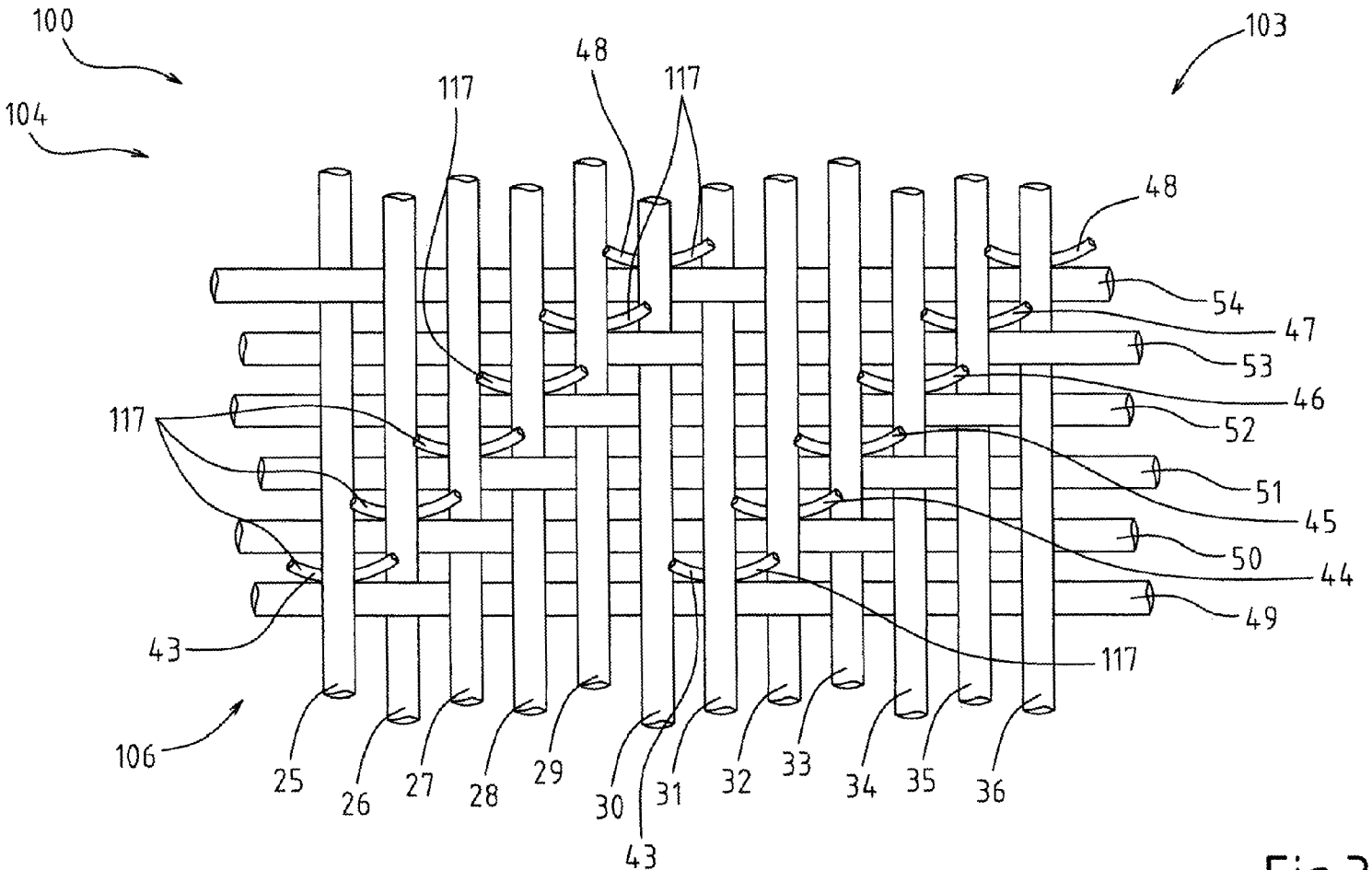
FIG. 3 is a schematic plan view from above of a bottom layer of the fabric of FIG. 1.
Figure 4B:
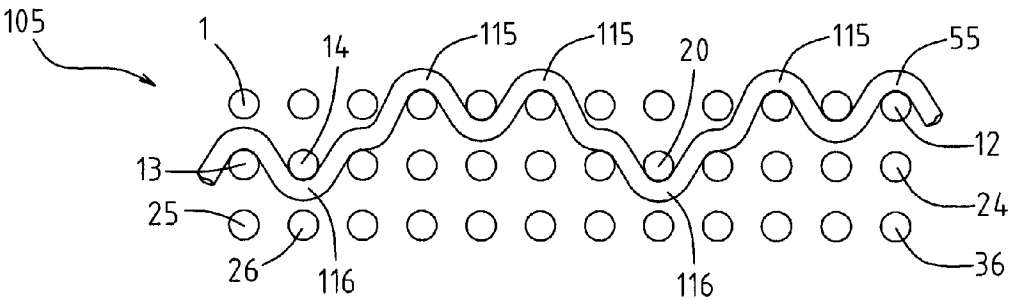
Figure 4C:
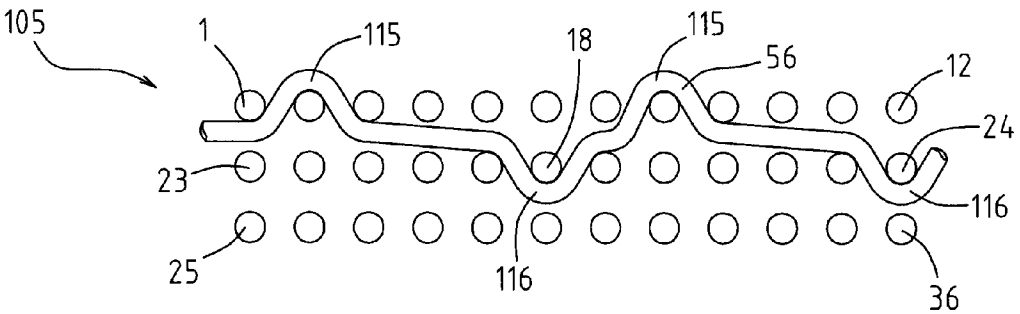
Figure 4D:
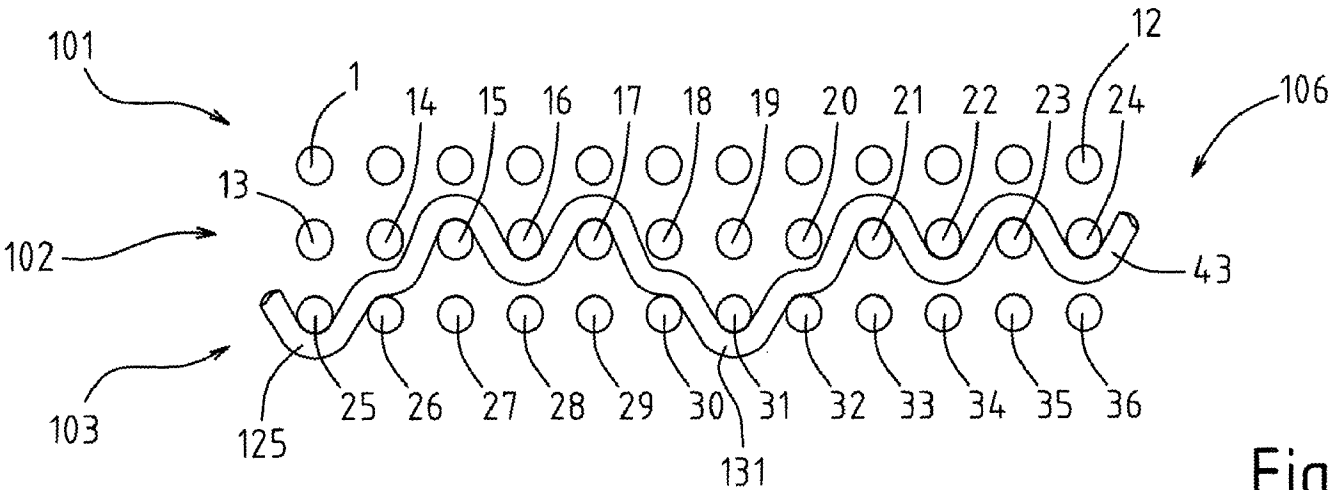

For example, as illustrated in FIGS. 2, 3 and 4*d*, the central CMD yarn 43 also defines a stitching yarn that is arranged under the central MD yarn 13, is interwoven with the bottom MD yarn 25 to form a first binding point 125 between the central layer 102 and the bottom layer 103, passes under the central MD yarn 14, over the central MD yarn 15, under the central MD yarn 16, over the central MD yarn 17, under the central MD yarn 18, under the central MD yarn 19, and is interwoven with the bottom MD yarn 31 to form a second binding point 131 between the layers 102, 103, and so on until it passes under the central MD yarn 24.

Similarly, every other central CMD yarn 44-48 which also defines a stitching yarn between the layers 102, 103 (and thus binds the bottom MD yarns 26-36 in at least two binding points 125) follows the same criteria as those described with reference to the central CMD yarn 43.

Each central CMD yarn or stitching yarn 43-48 can form one or more binding points 125 with the bottom MD yarns 25-36 in each fabric repeat unit; preferably, the binding points 125 formed by each stitching yarn defined by a central CMD yarn 43-48 are staggered, for example by one position in the cross machine direction, with respect to the binding points formed by the adjacent stitching yarns; in any case it is understood that the binding points 125 can be arranged differently and distributed in positions other than those described and illustrated purely by way of example. The number of binding points formed in each fabric repeat unit 104 by each central CMD yarn or stitching yarn 43-48 can also differ from that described. Preferably, each central CMD yarn or stitching yarn 43-48 passes, in each fabric repeat unit 104, under at least two non-adjacent (non-consecutive) bottom MD yarns 26-36.

In the example that is illustrated, all the central CMD yarns 43-48 define respective stitching yarns that are interwoven with the bottom MD yarns 25-36; it is understood that only some of the central CMD yarns 43-48 can be used as stitching yarns in the binding pattern 106, the remainder only being interlaced with the central MD yarns 13-24 to form the layer 102.

With reference to FIGS. 1, 2, 4*b* and 4*c*, the binder yarns 55-66 are interwoven with the top MD yarns 1-12 and with the central MD yarns 13-24, to form the binding pattern 105, as follows:

Each binder yarn 55-66 comprises, in a fabric repeat unit 104:

- one or more support portions 115, that are interwoven with the top MD yarns 1-12, and
- one or more binding portions 116, that are interwoven with the central MD yarns 13-24 under the top MD yarns 1-12.

The binder yarns 55-66 of each pair (though illustrated side by side, for the sake of clarity, in the schematic view in FIG. 1, which is not drawn to scale) are twisted together and vertically superimposed so that the support portions 115 of one binder yarn of the pair are superimposed to the binding portions 116 of the other binder yarn of the pair, and vice versa; the two binder yarns 55-66 of a pair intersect in correspondence with some of the top MD yarns 1-12 which define respective transition MD yarns, under which a binder yarn of each pair crosses the other binder yarn of the pair.

Each pair of binder yarns 55-66 can be interlaced in different ways with the top MD yarns 1-12 and the central MD yarns 13-24.

For example, with reference to the pair of binder yarns 55, 56, the support portion 115 of the odd-numbered binder yarn 55 is interlaced, in each fabric repeat unit 104, alternately with two separate series of three top MD yarns 4-6 and 10-12, in each series passing alternately over the two even-numbered top MD yarns (4, 6; 10, 12) and under the odd-numbered top MD yarn (5; 11); the support portion 115 of the even-numbered binder yarn 56 passes over the remaining two even-numbered top MD yarns (2, 8) and under the odd-numbered top MD yarns adjacent to these. Both the binder yarns 55, 56 of the pair pass under the top transition MD yarns (3, 7, 9).

The binder yarns 55-66 of each pair pass, with the respective support portions 115, over the top MD yarns under which the top CMD yarns 37-42 pass; in other words, the support portions 115 of the binder yarns 55-66 pass over the even-numbered top MD yarns 2, 4, 6, 8, 10, 12 (for each pair of binder yarns 55-66, one or the other of the binder yarns passes over each even-numbered top MD yarn). The support portions 115 of the binder yarns 55-66 pass instead under the top MD yarns over which the top CMD yarns 37-42 pass, i.e. under the odd-numbered top MD yarns 1, 3, 5, 7, 9, 11. For example, the binder yarn 55 passes, with its support portions 115, over the top MD yarns 4, 6, and 10, 12 while it passes under the top MD yarns 5, 11; and the binder yarn 56 passes, with its support portions 115, over the top MD yarns 2, 8. Both binder yarns 55, 56 pass under the top transition MD yarns 3, 7, 9. The other pairs of binder yarns 57-66 are interwoven in a similar fashion, but are preferably staggered with respect to the adjacent pairs of binder yarns by one or more top MD yarns. In this way, the binder yarns 55-66 and the top CMD yarns 37-42 form a plain weave (fabric) with the top MD yarns 1-12. It is understood that different types of weave or other weaving patterns can be used. The use of other patterns for interweaving the binder yarns 55-66 and the top MD yarns 1-12 is of course possible and the pairs of binder yarns 55-66 can also follow different weave patterns. In FIG. 1 for instance, the pairs of binder yarns 63, 64 and 65, 66 follow a different pattern; in any case, these pairs, like all the others, also bind the even-numbered top MD yarns and pass under the odd-numbered top MD yarns.

With reference to FIGS. 2 and 4*d*, the central layer 102 includes: the central MD yarns 13-24, the central CMD yarns 43-48, the binding portions 116 of the binder yarns 55-66. The central CMD yarns 43-48 are interwoven with the central MD yarns 13-24. The central MD yarns 13-24 and the central CMD yarns 43-48 are interwoven such as each central CMD yarn 43-48 passes alternately over and under the central MD yarns 13-24. The central CMD yarns 43-48 are interwoven with an over1/under1/over1/under3 sequence. For example (FIG. 4*d*), the central CMD yarn 43 passes under the central MD yarns 13, 14 and under the bottom MD yarn 25 (forming a first binding point 125 with the bottom layer 103), over the central MD yarn 15, under the central MD yarn 16, over the central MD yarn 17, under the central MD yarns 18, 19, 20 and under the bottom MD yarn 31 (forming a second binding point 125 with the bottom layer 103), over the central MD yarn 21, under the central MD yarn 22, over the central MD yarn 23, under the central ND yarn 24. The other central CMD yarns 44-48 follow a similar weaving pattern, but each central CMD yarn is staggered with respect to the adjacent central CMD yarns so as to form a continuous fabric. Clearly, a different weaving pattern or weave can be used.

The central layer 102 also includes (FIG. 2) the binding portions 116 of the binder yarns 55-66. Each binder yarn 55-66, in its binding portion 116, passes under at least one central MD yarn 13-24, and preferably under at least two non-consecutive central MD yarns 13-24, in each fabric repeat unit 104; in particular, the two binder yarns 55-66 of each pair follow, as a whole, an over1/under1/over1/under3 sequence on the surface of the central layer 102 (FIGS. 2, 4*b*, 4*c*).

For example, the binder yarn 55 passes under the central MD yarns 14, 20, and the binder yarn 56 passes under the central MD yarns 18, 24; each of these binder yarns passes over all the other central MD yarns. Thus, the binder yarns 55, 56 as a whole follow the over1/under1/over1/under3 sequence with respect to the central MD yarns 13-24.

The binder yarns of the other pairs follow the same sequence, but can be staggered with respect to the adjacent pair by one or more central MD yarns.

With reference to FIG. 3, the bottom layer 103 includes: the bottom MD yarns 25-36, the bottom CMD yarns 49-54, and the stitching portions 117 of the central CMD yarns 43-48 which define respective stitching yarns of the binding pattern 106 (between the central layer 102 and the bottom layer 103). The bottom CMD yarns 49-54 are interwoven with the bottom MD yarns 25-36 following the over1/under5 sequence. For example (FIG. 4*a*) the bottom CMD yarn 49 passes over the bottom MD yarn 26, under the bottom MD yarns 27-31, over the bottom MD yarn 32 and under the bottom MD yarns 33-36 and 25. The other bottom CMD yarns 50-54 follow a similar over1/under5 weaving pattern with respect to the bottom MD yarns 25-36, so as to form a diagonal six-heddle weave. Again this is clearly an example of a type of weave and other weaving patterns can be used.

The bottom layer 103 also includes (FIG. 3) the stitching portions 117 of the stitching yarns defined by the central CMD yarns 43-48. The stitching portions 117 pass under respective bottom MD yarns 25-36. In particular, each central CMD yarn or stitching yarn 43-48 passes, with its relative stitching portions 117, under the bottom MD yarns 25-36 so as to define an over5/under1 pattern on the bottom surface of the fabric (FIGS. 3 and 4*d*). For example, the stitching yarn 43 passes under the bottom MD yarns 25 and 31 defining respective binding points 125, and over all the other bottom MD yarns 26-30, 32-36 (FIGS. 2, 3 and 4*d*). The other central CMD yarns or stitching yarns 44-48 also follow the same over5/under1 sequence with respect to the bottom MD yarns 25-36, and are preferably staggered with respect to the adjacent central CND yarns by one or more bottom MD yarns.

As is apparent in particular from FIGS. 4*a*, 4*b*, 4*c*, 4*d* taken as a whole, the fabric repeat unit 104 is formed by three sets of superimposed warp yarns (top MD yarns 1-12, central MD yarns 13-24 and bottom MD yarns 25-36), and by five sets of weft yarns (top CMD yarns 37-42, central CMD yarns 43-48, bottom CMD yarns 49-54, pairs of binder yarns 55-66).

The fabric 100 is thus formed by three superimposed warp yarns (MD yarns) (i.e. a top MD yarn 1-12, a central MD yarn 13-24 and a bottom MD yarn 25-36) defining a warp unit that recurs in the cross machine direction (CMD) and by five weft yarns (CMD yarns: specifically a top CMD yarn 37-42, a central CMD yarn 43-48, a bottom CMD yarn 49-54, two binder yarns 55-66) defining a weft unit that recurs in the machine direction (MD); the ratio between weft yarns and warp yarns recurring respectively in the machine direction and in the cross machine direction (i.e. the ratio between the weft yarns and warp yarns that form, respectively, the weft unit and the warp unit) being hence 5:3.

In other words, the warp yarns recur in sets of three (each set of three being formed by a top MD yarn, a central MD yarn and a bottom MD yarn), so that warp units formed by three superimposed warp yarns recur in the cross machine direction; the weft yarns recur and follow on in the machine direction in sets of five (each set defining a weft unit formed by a top CMD yarn, a central CMD yarn, a pair of binder yarns, a bottom CMD yarn).

The ratio of 5:3 between weft yarns and warp yarns reflects the method used to weave the fabric 100: with each stroke (or insertion) of the fabric forming loom, for every three superimposed warp yarns five consecutive weft yarns are inserted onto the warp yarns.

For example, the top MD yarn 1, the central MD yarn 13 and the bottom MD yarn 25 superimposed one with respect to the other (as are all successive sets of three superimposed MD yarns) are associated, at each insertion or stroke of the loom, with a top CMD yarn (e.g. 37; FIG. 4*a*), a bottom CMD yarn (e.g. 49; FIG. 4*a*), a pair of binder yarns (e.g. 55, 56; FIG. 4*c*), a central CMD yarn (e.g. 43; FIG. 4*d*). In other words, in correspondence with each set of three superimposed MD yarns (each set of three being defined by a top MD yarn, a central MD yarn and a bottom MD yarn vertically superimposed) there are five CMD yarns. Each set of three warp yarns is associated with five weft yarns; the ratio between weft yarns and warp yarns is thus 5:3.

To the person skilled in the art it will be clear that the fabrics according to the present invention can differ in form. For example, with respect to the above description, the number and/or position of the pairs of binder yarns could differ with respect to the number and/or position of the top CMD yarns (for example there could be a pair of binder yarns for every two or three or more top CMD yarns, or there could be two or three or more pairs of binder yarns for each top CMD yarn).

The binder yarns of a pair could also be interwoven with different numbers of top and/or central CMD yarns, or one binder yarn of the pair could only be interwoven with the top or central CMD yarns.

The number of top, central and bottom CMD yarns in the fabric repeat unit 104 could also differ from that described and illustrated purely by way of example.

Moreover, all the weaving patterns or weaves described for the layers 101, 102, 103 could differ from those illustrated and described; for example, the top and central surfaces of the fabric 100 need not necessarily be defined by a plain or diagonal weave as illustrated, but could be a satin or twill weave etc.; and the bottom surface of the fabric need not necessarily have a diagonal weave, but could have any other form, such as a plain weave, broken twill, a rep weave, etc. Other alternative weave patterns can also be used in the fabric according to the present invention.

Different kinds of yarns can also be used in the fabric according to the invention, also depending on the characteristics of the finished product. For example, the yarns may be monofilament yarns, flat monofilament yarns, multifilament yarns, twisted multifilament or monofilament yarns, threads of any kind or any combination thereof. The materials used to produce the yarns can be those normally used in the sector. For example yarns made of polyester, polyamide, polyamide/polyester, or similar materials can be used. The person skilled in the art will be able to select the yarn material most suitable for the specific application in which the finished fabric is to be used.

Yarns of different forms and dimensions may be used. For example, the top MD yarns, the top CMD yarns and the binder yarns can have a diameter of between approx. 0.09 and 0.20 mm; the central MD yarns and the central CMD yarns can have a diameter of between approx. 0.09 and 0.18 mm; the bottom MD yarns can have a diameter of between approx. 0.18 and 0.25 mm; and the bottom CMD yarns can have a diameter of between approx. 0.20 and 0.35 mm.

The mesh (i.e. fabric density) of the fabric can also vary. For example, the mesh of the top surface can range from approx. 25×75 to 33×105 (warp yarns per cm×weft insertions per cm) and overall mesh can vary from between approx. 75×125 and 99×175. Since the top surface is formed, as described above, by the top ND yarns 1-12, the top CND yarns 37-42 and the support portions 115 of the binder yarns 55-66, the mesh values shown here refer, for the warp yarns, to the top MD yarns 1-12, and for the weft insertions to the top CMD yarns 37-42 and binder yarns 55-66 as a whole. The overall mesh values clearly refer to all the weft and warp yarns present.

A fabric with a six-heddle bottom layer produced according to the invention, for example, will have the characteristics shown in table 1.

TABLE 1

| YARN | Dimensions |
|---|---|
| Top MD | 0.10 mm |
| Central MD | 0.10 mm |
| Bottom MD | 0.20 mm |
| Binder CMD | 0.10 mm |
| Top CMD | 0.10 mm |
| Central CMD | 0.10 mm |
| Bottom CMD | 0.22 mm |
| Mesh (top surface) | 33 × 60* |
| Mesh (overall) | 99 × 150* |

*warp yarns per cm × weft insertions per cm

According to a further aspect of the invention, the fabric 100 described above is used in a papermaking process, in particular in the forming section of a papermaking machine. The method comprises the steps of:

(a) providing a papermaking fabric as described above;

(b) applying an aqueous cellulose pulp and/or a paper material to be formed to the top surface of the fabric; and (c) removing water from the pulp and/or the paper material being formed.

The person skilled in the art will be familiar with the remainder of said method and therefore no further details are necessary.

It is understood that further modifications and variations can be implemented to the embodiment described herein without departing from the scope of the invention as set forth in the claims.

The invention claimed is:

1. A quadruple papermaking fabric, in particular a forming fabric for use in the forming section of a papermaking machine, having at least one fabric repeat unit and comprising:

a set of warp machine direction (MD) top yarns;

a set of weft cross machine direction (CMD) top yarns interwoven with the top MD yarns to form a top fabric layer;

a set of central MD yarns;

a set of central CMD yarns interwoven with the central MD yarns to form a central fabric layer;

a set of bottom MD yarns;

a set of bottom CMD yarns interwoven with the bottom MD yarns to form a bottom fabric layer;

wherein in the fabric repeat unit the top layer is bound only to the central layer and the bottom layer is bound only to the central layer by respective independent binding patterns, formed by respective distinct sets of yarns arranged in the cross machine direction;

the first binding pattern being formed by a set of pairs of binder yarns, each pair being positioned between two adjacent top CMD yarns and having at least one yarn that interweaves with both the top MD yarns and the central MD yarns; the binder yarns of each pair being twisted with respect to each other and vertically superimposed and positioned between two adjacent top CMD yarns;

the second binding pattern being formed by at least some central CMD yarns that interweave with the central MD yarns and also with the bottom MD yarns (25-36), but not with the top MD yarns, so as to define respective stitching yarns that bind the central layer and the bottom layer;

and wherein the binder yarns comprise respective support portions, that interweave with the top MD yarns, and respective binding portions, that interweave with the central MD yarns beneath the top MD yarns; the binder yarns of each pair being twisted with each other and vertically superimposed, so as the support portions of a binder yarn of the pair are superimposed to the binding portions of the other binder yarn of the pair, and vice versa;

the binder yarns of each pair passing, with the respective support portions, over the top MD yarns under which the top CMD yarns pass, and the support portions of the binder yarns pass instead under the top MD yarns over which the top CMD yarns pass, so that the binder yarns and the top CMD yarns form a plain weave pattern with the top MD yarns;

and wherein the fabric is formed by three superimposed warp yarns defining a warp unit that recurs in the cross machine direction (CMD), and by five weft yarns defining a weft unit that recurs in the machine direction (MD); the ratio between weft yarns and warp yarns recurring in the machine direction and in the cross machine direction respectively being hence 5:3.

2. A fabric according to claim 1, wherein the other yarn of each pair of binder yarns interweaves with both the top MD yarns and the central MD yarns, or only with the top MD yarns, or only with the central MD yarns.

3. A fabric according to claim 1, wherein both binder yarns of each pair interweave with the top MD yarns and the central MD yarns.

4. A fabric according to claim 1, wherein the binder yarns of each pair are positioned between two adjacent central CMD yarns defining respective stitching yarns.

5. A fabric according to claim 1, wherein the top MD yarns, the top CMD yarns and the binder yarns as a whole form a plain weave pattern on a top surface of the fabric.

6. A fabric according to claim 1, wherein each central CMD yarn is interwoven with the bottom MD yarns.

7. A fabric according to claim 1, wherein the top MD yarns and the top CMD yarns are interwoven in a series of repeat units; and the central MD yarns and the central CMD yarns, and the bottom MD yarns and the bottom CMD yarns, are interwoven in corresponding respective repeat units to form a series of fabric repeat units.

8. A fabric according to claim 1, wherein in each fabric repeat unit there is the same number of top MD yarns, of central MD yarns and of bottom MD yarns.

9. A fabric according to claim 1, wherein in each fabric repeat unit there is the same number of top CMD yarns, of central CMD yarns and of bottom CMD yarns.

10. A fabric according to claim 1, wherein in each fabric repeat unit each bottom MD yarn passes under only one bottom CMD yarn.

11. A fabric according to claim 1, wherein the fabric has a top surface having a mesh ranging between about 25×75 and about 33×105 (epcm to ppcm).

* * * * *